United States Patent [19]

Sasaki et al.

[11] Patent Number: 4,795,379

[45] Date of Patent: Jan. 3, 1989

[54] FOUR LEAF RECEPTACLE CONTACT

[75] Inventors: Takinori Sasaki; Noriaki Takenaka, both of Tokyo, Japan

[73] Assignee: AMP Incorporated, Harrisburg, Pa.

[21] Appl. No.: 84,647

[22] Filed: Aug. 12, 1987

[30] Foreign Application Priority Data

Aug. 27, 1986 [JP] Japan ..... 61-201209

[51] Int. Cl.[4] ..... H01R 13/54

[52] U.S. Cl. ..... 439/856; 439/862

[58] Field of Search ..... 439/842, 850, 855, 856, 439/861, 862

[56] References Cited

U.S. PATENT DOCUMENTS

Re. 26,878 5/1970 Sitz .
1,477,527 12/1923 Raettig ..... 439/862
4,140,361 2/1979 Lochor ..... 439/856
4,288,139 9/1981 Cobaugh et al. .
4,303,294 12/0181 Hamsher, Jr. et al. .
4,591,230 5/1986 Roldan ..... 439/856

*Primary Examiner*—Joseph H. McGlynn
*Attorney, Agent, or Firm*—William B. Noll; Gerald K. Kita

[57] ABSTRACT

A receptacle content comprises a pair of opposed leaf spring members having first spring arms provided with outer contact members and second spring arms extending along the first spring arms provided with inner contact members.

An electrical connector includes a dielectric housing in which electrical receptacle contacts are arranged in rows with contact members of the contacts in the rows being staggered so that upon matable connection with a complmentary electrical connector the electrical connection between the respective electrical contacts of the matable connectors is sequentially completed.

14 Claims, 3 Drawing Sheets

FOUR LEAF RECEPTACLE CONTACT

FIELD OF THE INVENTION

This invention relates to an electrical receptacle contact which is small in size and thus can be used for higher density applications. In particular, the receptacle contact is provided with a cleaning function by which foreign matter on the tab contact is removed at the time of electrical connection therewith.

BACKGROUND OF THE INVENTION

Computers and telephone switchboards such as PBX's and other data processing equipment have been made smaller as well as increasing the speed at which the signal information is processed. This has required miniaturizing the components and increasing the density thereof including the electrical contacts for making the electrical connections therefor. Contacts that have been used for the electrical connections as shown in FIG. 6 are in the form of a receptacle contact in which four resilient cantilever contact members 1*a*,1*b* and 2*a*,2*b* extend forwardly from a base 3 for electrical connection with a tab contact inserted from the front. The tab contact is electrically engaged by the four leaves 1*a*,1*b* and 2*a*,2*b* from four directions. In this prior art contact, the four leaves are arranged as opposing pairs, and each pair is arranged orthogonally as shown in FIG. 6.

In the above-mentioned receptacle contact, electrical engagement is made with the tab contact at four points, thus, the reliability of the receptacle contact is improved in comparison with a contact having only two contact points. However, a problem arises in that a possibility of an incomplete electrical engagement caused by foreign matter on the surface of the tab contact can take place. Furthermore, one of the pair of contact members 1*a*,1*b* or 2*a*,2*b* may engage the edge surfaces of the tab contact, therefore these contact members will not provide a reliable electrical connection. The edge surfaces of the tab contact are the surfaces of edges formed when the tab contact is made by stamping a sheet of conductive material. These surfaces are rough in comparison with the planar rolled or formed surface of the sheet, they have a lower contact reliability, and a greater insertion force is required at the time of insertion. Further, in the case of the receptacle contact shown in FIG. 6, the contact members electrically engage the post terminal at spaced opposed locations which makes it difficult to increase the mounting density because the size of the contact is large. This requires that the spacing between contacts must be made larger when a plurality of contacts are mounted in a housing or on a printed circuit boad.

SUMMARY OF THE INVENTION

The object of this invention is to provide a receptacle contact which is smaller in size to obtain higher density spacing, and it has a higher contact reliability. The receptacle contact of this invention comprises a pair of opposed leaf spring members having first spring arms provided with outer contact members and second spring arms extending along the first spring arms which are provided with inner contact members. The receptacle contact can take the form of a unitary leaf spring member having a long spring arm with an outer contact member and a short spring arm extending along the long spring arm which has an inner contact member in alignment with the outer contact member.

When a tab contact is inserted in the four leaf receptacle contact, it is first engaged by the outer contacts which wipe and therefore remove any foreign matter on the tab contact by the outer contacts. Then, further insertion of the tab contact into the receptacle contact connects the inner contact members with the tab contact. Therefore, a reliable connection is established between the second contact members and the tab contact which is not affected by any foreign matter. The outer contact members and the inner contact members engage respective surfaces of the tab contact so that they are both in redundant electrical engagement with such surfaces. The outer contact members are about twice the width of the inner contact members thereby assuring cleaning of the tab contact surfaces during engagement therebetween. Further, since each spring arm is arranged in the same direction, the width of both spring arms on each leaf spring member can be made smaller than in the prior art contact shown in FIG. 6, thus a better contact density can be realized.

DETAILED DESCRIPTION OF THE INVENTION

The following is a description of the preferred embodiment of this invention by way of example with reference to the accompanying drawings.

Receptacle contact 10 according to this invention is stamped and formed from a suitable electrically-conductive metal sheet having the desired spring characteristics. It is comprised of opposed leaf spring members 11*a*,11*b* which are two parallel plates that the linked through a U-shaped portion 11*c* extending between adjacent sides of members 11*a*,11*b*. Members 11*a*,11*b* include first spring arms 12,13 and second spring arms 14,15 which are formed integrally with leaf spring members 11*a*,11*b*.

Spring arms 12,13 and spring arms 14,15 are opposed to each other, and outer contact members 12*a*,13*a* and inner contact members 14*a*,14*b* at the free ends of spring arms 12,13 and 14,15 respectively are also opposed to each other. Further, contact members 14*a*,15*a* are located to the rear of contact members 12*a*,13*a*. Spring arms 12,13 and 14,15 extend side-by-side from leaf spring members 11*a*,11*b* and outer contact members 12*a*,13*a* are slightly twice the width of inner contact members 14*a*,15*a*. Contact members 12*a*,13*a*,14*a*,15*a* are arcuate to facilitate insertion of a tab contact therebetween. Note that the direction of arrow A denotes the front of contact 10 in FIGS. 1,2A,2B.

Figure 6:
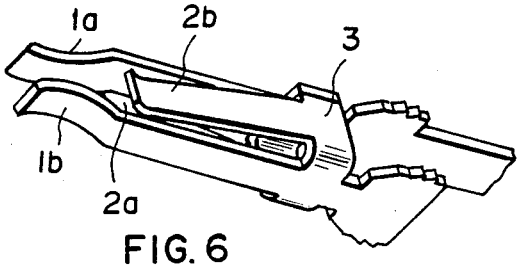
FIG. 6 is a perspective view of a prior art receptacle contact.

Contact leg 16 which projects rearward is integrally formed adjacent the rear of base 11*a*. Since the receptacle contact 10 formed as explained above is formed with contact members 12*a*,13*a* and 14*a*,15*a* which are respectively opposed, the width W can be the same as the width of the complementary tab contact, and thus is reduced in comparison with the width of the prior are receptacle contact shown in FIG. 6, thereby resulting in a smaller receptacle contact.

Figure 1:
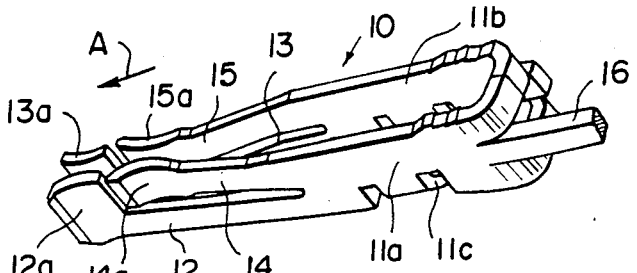
FIG. 1 is a perspective view of a receptacle contact according to this invention.
Figure 2A:
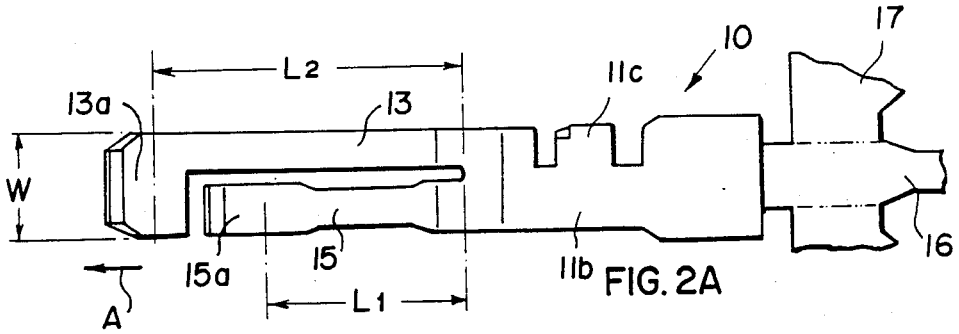
FIGS. 2A to 2C are a top view, a side view, and a lateral cross-sectional view along the line II—II, of FIG. 2B respectively, of the receptacle contact.
Figure 2B:
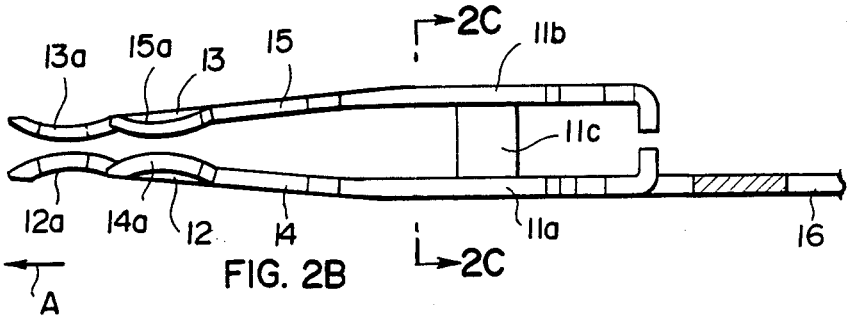
Figure 2C:
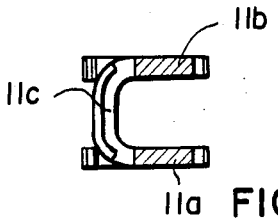
Figure 3:
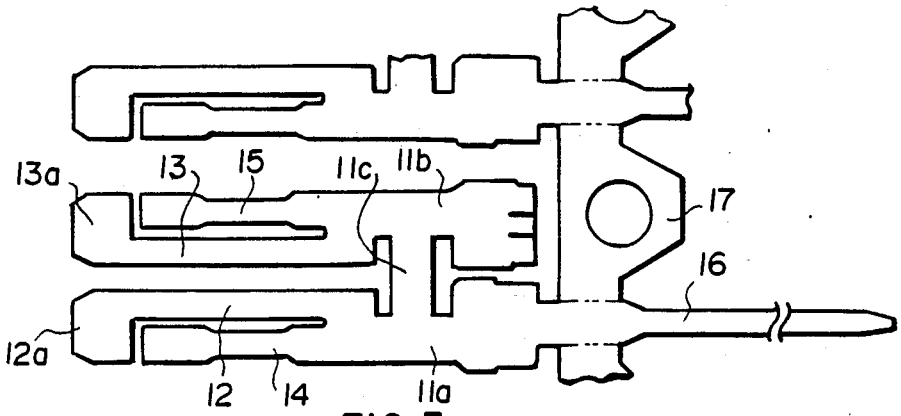
FIG. 3 is a top view showing a blank of the receptacle contact in a stamped configuration prior to being formed.

Receptacle contact 10 having the above shape is made by stamping and forming from a suitable metal sheet having the desirable conductive and spring characteristics. The stamping process is conducted by shaping the metal sheet as shown in FIG. 3, and then folding the spring arms 12,13 and 14,15 to the shape required while folding portion 11*c* into a U-shape. Accordingly, spring arms 12,13 and 14,15 are made to oppose each other, and the four leaf contact 10 with the shape shown in FIGS. 1 and 2 is produced. In this process, a plurality of contacts 10 are formed at the same time, and therefore, each contact 10 is joined to another in one row through a portion 17, and portion 17 is cut along a broken line as shown in FIGS. 2A,3 when the contacts are to be used. Portions 17 also have holes 17*a* therein forming a carrier strip for feeding the row of contacts through application equipment.

Figure 4A:
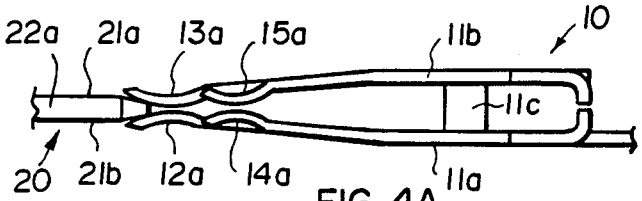
FIGS. 4A to 4C are side views showing the action of the receptacle contact and the tab contact when the tab contact is inserted in the receptacle contact.
Figure 4B:
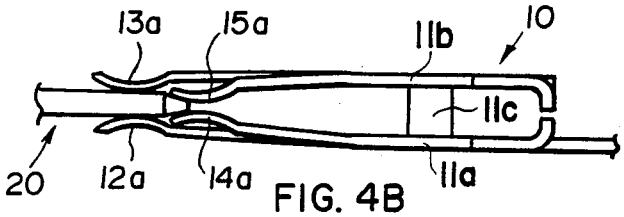

The following is an explanation of the electrical connection of the receptacle contact 10 made as explained above with tab contact 20, with reference to FIGS. 4A to 4C. Tab contact 20 has tapered surfaces at its front end to facilitate insertion into the arcuate contact members 12*a*,13*a*,14*a*,15*a*.

Figure 4C:
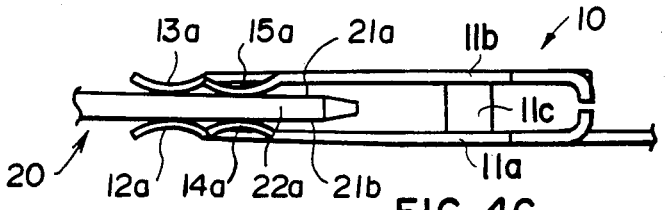

First, the tip of tab contact 20 is inserted in the space between outer contact members 12*a*,13*a* opposed to each other at the front portion of the receptacle contact 10. Upon insertion, upper and lower surfaces 21*a*,21*b* of contact 20 are brought into wiping engagement with contact members 12*a*,13*a*; accordingly, foreign matter on upper and lower surfaces 21*a*,21*b* of contact 20 is removed. When contact 20 is inserted further, upper and lower surfaces 21*a*,21*b* which have been cleaned by contact members 12*a*,13*a*, are also wipingly engaged by contact members 14*a*,15*a* while still being engaged by contact members 14*a*,15*a*, as shown in FIG. 4C. Therefore, the surfaces of contact 20 in electrical engagement with contact members 14*a*,15*a* are free from any foreign matter because of the cleaning function carried out by contact members 12*a*,13*a*. Surfaces 21*a*,21*b* of tab contact 20 are assured of being cleaned in the area of electrical engagement by contact members 14*a*,15*a* because contact members 12*a*,13*a* are about twice the width of contact members 14*a*,15*a*. Thus, a greater electrical connection reliability between contact 20 and inner contact members 14*a*,15*a* is realized. At this time, preferably outer contact members 12*a*,13*a* and inner contact members 14*a*,15*a* are in electrical engagement with upper and lower surfaces 21*a*,21*b*, which are the planar surfaces, of contact 20, and not with surfaces 22*a*,22*b*, (only 22*a* being shown) which are the cut edge surfaces of contact 20. This decreases the force needed to insert contact 20 into receptacle contact 10 thereby improving the reliability of the electrical connection therebetween.

Also, in receptacle contact 10, the length L1 of spring arms 12,13 which provide the contact force created between contact members 12*a*,13*a* and contact 20, is longer than the length L1 of spring arms 14,15, which provide the contact force between contact members 14*a*,15*a* and contact 20. Therefore, the insertion force is reduced by reducing the contact force created between contact 20 and contact members 12*a*,13*a*, which clean upper and lower surfaces 21*a*,21*b* of contact 20 by engagement with contact members 12*a*,13*a*, and an excellent electrical engagement is provided between surfaces 21*a*,21*b* of contact 20 and contact members 14*a*,15*a* by increasing the contact force created between contact members 14*a*,15*a* and contact 20. Thus, the initial insertion force of tab contact 20 within contact members 12*a*,13*a* is less than the insertion force of contact members 14*a*,15*a*.

Figure 5:
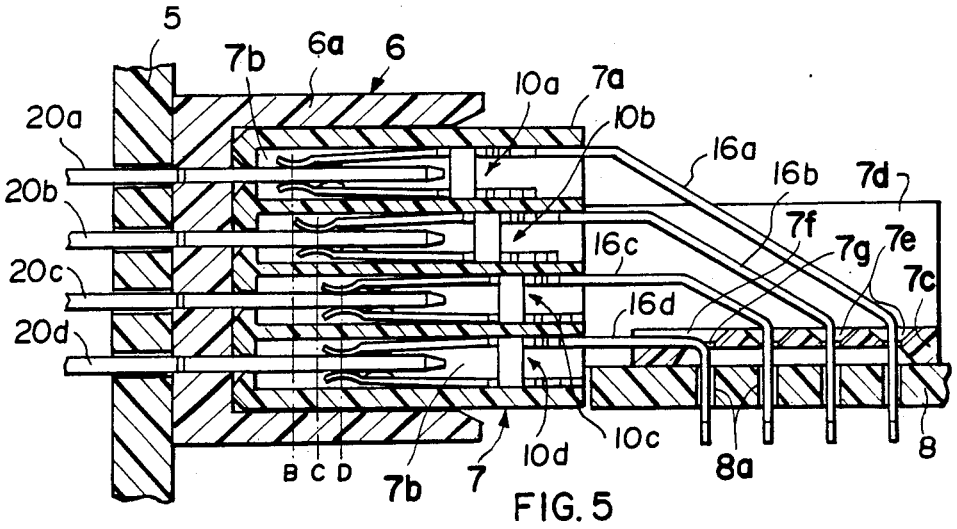
FIG. 5 is a cross-sectional view showing an electrical connector having a plurality of receptacle contacts connected to tab contacts of header connector.

The following is an example of an electrical connector as shown in FIG. 5 in which a plurality of the above-mentioned receptacle contacts 10 are used for electrical connection with a plurality of tab contacts 20. In this case, a header connector 6 having a dielectric housing 6*a* including a plurality of tab contacts 20*a*–20*d* is mounted on a first wiring board 5 with contacts 20*a*–20*d* being electrically connected respectively with conductive paths of the first wiring board. Also, a plurality of receptacle contacts 10*a*–10*d*, which are shown electrically connected to contacts 20*a*–20*d*, are arranged and retained in contact-retaining passages 7*b* of a dielectric housing 7*a* of matable electrical connector 7. Further, contact legs 16*a*–16*d* at the rear end of each of receptacle contacts 10*a*–10*d* are electrically connected to respective conductive paths on second wiring board 8. A dielectric spacer 7*c* extends between side walls 7*d* (only one being shown) and it has tapered holes 7*e* through which legs 16*a*–16*c* extend so that the outer ends of legs 16*a*–6*c* are in alignment and properly spaced for disposition in respective holes 8*a* in board 8. Inner sections of legs 16*d* are disposed in recesses 7*f* of spacer 7*c*. Recesses 7*f* communicate with apertures 7*g* through which the outer ends of legs 16*d* extend for alignment and positioning in holes 8*a*.

Connector housing 7*a* of connector 7 having a plurality of receptacle contacts 10*a*–10*d* is inserted in housing 6*a* of header connector 6, and accordingly, each tab contact 20*a*–20*d* is respectively electrically engaged by each receptacle contact 10*a*–10*d*, thus both connectors are electrically connected, as shown in FIG. 5. According to connector 7, the positions of outer contact members 12*a*,13*a* of receptacle contacts 10*a*–10*d* in passages 7*b* of housing 7*a* are arranged at different positions therein, as shown by B,C, and D in FIG. 5, so that the contact members of the upper row of contacts 10*a* is at position B, the next row of contacts 10*b* have the contact members at position C and the contact members of contacts 10*c*,10*d* are at position D. Thus, the insertion of tab contacts 20*a*–20*d* into receptacle contacts 10*a*–10*d* is sequentially conducted in order to reduce the insertion force required when connector housing 7*a* of connector 7 is inserted in housing 6*a* of header connector 6. Moreover, receptacle contact 10*a*, which makes contact at position B, is used as the receptacle contact for ground, and preferably, the connection of the ground is first carried out to avoid short circuiting at the time of the connection. In addition, the receptacle contact 10*b*, which makes contact at the position C, is used as the contact for the power source, and the receptacle contacts 10*c*–10*d*, which make contact at the position D, are used as the contacts for signal transmission. In this way, the insertion force when the connectors 6 and 7 are connected is reduced and the ground and power connections are made before the signal connections are made. When the connectors are disconnected, the signal connections are disconnected before the power and ground connections. Thus, the signal connections are protected during the connecting and disconnecting of the connectors.

As explained above, according to this invention, when a tab contact is inserted in a receptacle contact, any foreign matter is first removed from the surfaces thereof by the wiping action of the outer contact members, and the cleaned surfaces then electrically engage the inner contact members. Thus, the connection of the inner contact members and the tab contact is not affected by foreign matter, therefore, a reliable electrical connection is effected. Further, since both the outer and inner contact members are arranged to be respectively opposed in the same direction, the width in the lateral direction can be reduced, and thus the mounting density can be increased because of the considerable reduction of the size of the receptacle contact.

We claim:

1. An electrical contact for electrical connection with a tab contact, comprising:

a leaf spring in the form of unitary plate having a long spring arm with an outer contact member, and a short spring arm extending beside said long spring arm with inner contact member, said long spring arm and said short spring arm being freely movable relative to one another, said outer contact member having a contact surface of width about twice that of said contact surface of said inner contact member so as to extend across the inner contact member and is in axial alignment with said inner contact member so that said outer contact member initially engages a major surface of the tab contact during relative movement of the tab contact and the electrical contact, thereby cleaning said major surface and said inner contact member next engages the said cleaned major surface.

2. An electrical contact as claimed in claim 1, wherein said leaf spring includes opposed leaf springs linked together via a linking member.

3. An electrical contact as claimed in claim 1, wherein said outer and inner contact members are arcuate.

4. An electrical contact for electrical connection with a tab contact, comprising opposed leaf spring members formed from a suitable electrically-conductive metal sheet having spring characteristics, each said leaf spring member comprising (a) a long spring arm with an outer contact member having a width of dimension W, and (b) a short spring arm beside said long spring arm and freely movable relative thereto, and having an inner contact member having a width of a dimension of about W/2, whereby said outer contact member extends across the inner contact member and is in axial alignment with said inner contact member so that said outer contact member initially engages a major surface of the tab contact during relative movement of the tab contact and the electrical contact thereby cleaning said surface, and said inner contact member next engages said cleaned surface.

5. An electrical contact as claimed in claim 4, wherein said leaf spring includes opposed leaf springs linked together via a linking member.

6. An electrical contact as claimed in claim 4, wherein said long spring arm and said short spring arm are respectively opposed to one another.

7. An electrical contact as claimed in claim 4, wherein said outer and inner contact members are arcuate.

8. An electrical contact for electrical connection with a tab contact, comprising opposed leaf spring members linked together by a U-shaped member and formed from a suitable electrically-conductive metal sheet having spring characteristics, each said leaf spring member comprising (a) a long spring arm with an outer contact member having a width of dimension W, and (b) a short spring arm beside said long spring arm and freely movable relative thereto, and having an inner contact member having a width of a dimension of about W/2, (c) each said outer contact member extending across the adjacent inner contact member and in axial alignment therewith, whereby, during relative movement of said tab contact and said electrical contact, sequentially said tab contact initially engages said outer contact members to cause a cleaning of said tab contact prior to engagement and electrical contact with said inner contact members.

9. An electrical contact as claimed in claim 8, where said outer and inner contact members are arcuate to facilitate insertion of the tab contact therein.

10. An electrical connector for electrical connection with a complementary electrical connector, comprising:

dielectric housing means having rows of contact-receiving passages in which electrical contacts are secured;

a first row of electrical contacts defining ground contacts;

a second row of electrical contacts defining signal contacts;

a third row of electrical contacts defining signal contacts;

electrical contact members provided by said electrical contacts;

the contact members of said first to third rows of said electrical contacts are staggered such that said first row of contacts are spaced closer to the front of the housing means than the contact members of the second row of contacts which are spaced closer to the front of the housing means than the contact members of the third row of contacts so that the matable electrical contact means of the complementary electrical connector when mated with said electrical connector electrically connect with the electrical contact members of the first, second and third rows of electrical contacts in sequence with the ground connections being made first, the power connections being made second and the signal connections being made third.

11. An electrical connector as claimed in claim 10, wherein said electrical contacts each comprise receptacle contact members having opposed leaf spring members linked together by linking means and first spring arms and second spring arms, said first spring arms including outer contact members, said second spring arms including inner contact members.

12. An electrical connector as claimed in claim 11, wherein said inner and outer contact members are in axial alignment.

13. An electrical connector as claimed in claim 11, wherein said outer contact members are about twice the width of said inner contact members.

14. An electrical connector as claimed in claim 11, wherein said inner and outer contact members are arcuate.

* * * * *